United States Patent [19]

Dufour et al.

[11] 4,436,616

[45] Mar. 13, 1984

[54] PROCESS FOR THE BENEFICIATION OF PHOSPHATE ORES

[76] Inventors: Philippe Dufour, Les Hauts-Bouleaux, 30740 Saint-Laurent Le Minier; Jean-Jacques Predali, 2, rue de Blanquefort, 78310 Elancourt, both of France; Guy Ranchin, deceased, late of Versailles, France; by Marc Ranchin, legal heir; by Genevieve Ranchin, legal heir, both of 16 rue Albert Joly, Versailles, France

[21] Appl. No.: 363,652

[22] Filed: Mar. 30, 1982

Related U.S. Application Data

[63] Continuation-in-part of Ser. No. 204,520, Nov. 6, 1980, abandoned.

[51] Int. Cl.[3] ..... B03D 1/06

[52] U.S. Cl. ..... 209/3; 209/166; 209/167

[58] Field of Search ..... 209/166, 167, 12, 3; 75/119

[56] References Cited

U.S. PATENT DOCUMENTS

| | | | |
|---|---|---|---|
| 2,216,040 | 9/1940 | Mead | 209/166 |
| 2,293,640 | 8/1942 | Crago | 209/166 |
| 2,295,459 | 9/1942 | Erickson | 209/166 |
| 2,661,842 | 12/1953 | Duke et al. | 209/166 |
| 2,706,557 | 4/1955 | Houston et al. | 209/166 |
| 3,086,654 | 4/1963 | Hollingsworth et al. | 209/166 |
| 3,088,590 | 5/1963 | Haseman et al. | 209/166 |
| 3,099,620 | 7/1963 | Adam | 209/166 |
| 3,113,838 | 12/1963 | Perri et al. | 23/165 |
| 3,137,650 | 6/1964 | Smith et al. | 209/12 |
| 3,225,923 | 12/1965 | Lawver et al. | 209/3 |
| 3,259,242 | 7/1966 | Snow | 209/166 |
| 3,314,537 | 4/1967 | Greene | 209/166 X |
| 3,348,675 | 10/1967 | Tveter | 209/5 |
| 3,349,903 | 10/1967 | Olsen | 209/3 |
| 3,400,813 | 9/1968 | Clitherue | 209/166 X |
| 3,403,783 | 10/1968 | Andery et al. | 209/167 |
| 3,454,159 | 7/1969 | Hollingsworth et al. | 209/3 |
| 3,462,016 | 8/1969 | Bushell et al. | 209/166 |
| 3,462,017 | 8/1969 | Bushell et al. | 209/166 |
| 3,534,854 | 10/1970 | Korpi et al. | 209/166 |
| 3,750,963 | 8/1973 | Dancy | 241/20 |
| 3,782,539 | 1/1974 | Painter | 209/2 |
| 3,807,556 | 4/1974 | Johnston | 209/166 |
| 3,860,689 | 1/1975 | Sefton | 75/119 X |
| 4,144,969 | 3/1979 | Snow | 209/166 |
| 4,175,790 | 11/1979 | Predali | 209/7 |
| 4,189,103 | 2/1980 | Lawver et al. | 209/166 |

FOREIGN PATENT DOCUMENTS

| | | |
|---|---|---|
| 914572 | 6/1946 | France . |
| 914699 | 6/1946 | France . |
| 2320781 | 3/1977 | France . |
| 859155 | 1/1961 | United Kingdom . |

*Primary Examiner*—Tim R. Miles
*Assistant Examiner*—William J. Bond
*Attorney, Agent, or Firm*—Fleit, Jacobson, Cohn & Price

[57] ABSTRACT

This invention provides a process for the beneficiation of phosphate ores having a magnesia-rich carbonate-containing gangue and a silica-containing gangue, which process comprises subjecting the phosphate ore particles to controlled attrition to remove at least a portion of the magnesia-rich carbonate-containing gangue; and subjecting the phosphate ore resulting from attrition to a plurality of flotations to remove the remaining magnesia-rich carbonate-containing gangue and the silica-containing gangue and to recover a concentrated phosphate product, the flotations including sequentially a phosphate flotation, a silica flotation and a carbonate flotation. Alternatively, the controlled attrition can be employed after the silica flotation and prior to the carbonate flotation.

28 Claims, 3 Drawing Figures

PROCESS FOR THE BENEFICIATION OF PHOSPHATE ORES

This application is a continuation-in-part of application Ser. No. 204,520, filed Nov. 6, 1980, now abandoned.

BACKGROUND OF THE INVENTION

Field of the Invention

This invention is related to a process for the beneficiation of phosphate ores. More particularly, this invention relates to a process for the beneficiation of phosphate ores having a gangue containing dolomite and/or calcite as well as silica.

Phosphates obtained from phosphate ores are used for the production of phosphoric acid. To be economically marketable, the phosphates must have a low impurities content. Among the most detrimental impurities found in phosphates are iron, aluminum, and magnesia. Phosphate ores having a magnesia-rich dolomitic gangue and which also contain calcite are found in Florida. Because of the high magnesia content, such phosphate ores have been considered uneconomical to process.

According to the processes known in the prior art and used in Florida for the treatment of phosphates with a siliceous gangue, the ore is first washed and classified into four fractions which are processed separately. The fine particles, i.e., those having a diameter of less than about 104 microns (i.e., those which pass through a 150 mesh Tyler sieve series), and which consists mainly of clays, are considered to be waste. The other three fractions have particle diameters ranging from about 104 to 417 microns (i.e., those which pass through a 35 mesh Tyler sieve series and are retained on a 150 mesh Tyler sieve series), from about 417 to 1000 microns (i.e., those which pass through a 16 mesh Tyler sieve series and are retained on a 35 mesh Tyler sieve series) and greater than about 1000 microns (i.e., those which are retained on a 16 mesh Tyler sieve series). Among these three fractions, the fraction having a particle diameter exceeding about 1000 microns is sufficiently rich so as not to require any treatment.

The fractions of particles having a diameter ranging from about 104 to 417 microns and from about 417 to 1000 microns are subjected to a flotation process. The flotation process is normally performed in two stages. The first stage comprises an anionic flotation of phosphates either in flotation cells for the fine particles (104–417 microns, i.e., 150–35 mesh), or on belts for the coarse particles (417–1000 microns, i.e., 35–16 mesh). In the course of the flotation, the larger part of the silica is taken along with the residue. To further improve the quality of the resulting phosphate product, a second stage flotation to eliminate the rest of the silica is necessary. This is accomplished for both the fine and coarse particles by washing, and conditioning the particles before subjecting the two fractions to a cationic flotation, which is designed to eliminate the residual silica.

The above-described process has been in use for many years. However, this process cannot be used for the treatment of phosphate deposits having a carbonate gangue containing calcite and dolomite in addition to the usual silicates. Consequently, the above-mentionned process cannot be used for beneficiating the carbonate rich layers of the phosphate deposits found in Florida. This is due to the fact that carbonates have the same behavior as phosphate particles under usual industrial flottation conditions. As a result, the carbonate particles cannot be removed from the phosphate particles. Apparently, the affinity of carbonates and phosphates for fatty acids in anionic flottation processes is about the same, thus preventing separation thereof.

A large number of studies have been directed to the removal of carbonates from phosphate ore having a carbonate-containing gangue. For example, British Patent No. 859,155, which corresponds to U.S. Pat. No. 3,113,838, discloses a process applicable to phosphate-rich rock containing calcium carbonate. The process comprises grinding the rock to 200 microns to liberate the phases, floating the carbonates at a pH of 6 to 7 with fatty acids while depressing the flotation of the phosphates by adding soluble phosphate salts to the solution obtained. However, the process disclosed in this reference is not applicable to ores which have both carbonate and silicate gangue.

Another known process applicable to essentially calcitic ore is described in U.S. Pat. No. 3,259,242. In this process, the cationic flottation of the phosphates at a pH of 7 is disclosed. Flotation is followed by washing with $SO_2$ or $H_2SO_4$. However, this process cannot be applied to ores having a siliceous gangue since it is well known in the art that the silicates are equally floatable with amines used as cationic flotation agent. Furthermore, the use of sulfuric acid or sulfur dioxide incurs an additional expense, thus increasing the cost of the process.

Another cationic flotation method for phosphate is described in U.S. Pat. No. 4,144,969 for ore with a carbonate and silica (less than about 20% by weight) containing gangue. Apatite is floated with a cationic reagent at a pH of from about 5 to 6.5. Carbonates are eliminated in the tailings of the flotation. The pH is maintained with different acids such as acetic, phosphoric, hydrochloric, nitric and hydrofluoric acids.

Other processes have been developed wherein the elimination of phosphates by flotation is described. For example, as described in *Mining Engineering,* January 1978, at pages 37 to 40, a process utilizing the elimination of phosphates by means of $H_2SiF_6$ is described. Similarly, U.S. Pat. Nos. 3,462,016, 3,462,017, and 3,807,556 disclose processes for treating ores having a carbonate- and silica-containing gangue by using two anionic flotation steps. In particular, the technique which has been described in U.S. Pat. Nos. 3,462,016 and 3,462,017, and which seemed to be the most promising one, does not lead to concentrates that can be considered marketable.

That technique consists in a first stage designed to produce a fine grind ($d_{80}$=200 mesh or 74 microns), followed by a second stage for bringing about an anionic flotation by means of an anionic collector used by itself (without any fuel oil), followed by a third stage intended to take up the concentrate which is still impregnated with the collector, with a small additional amount, if the need for that is felt, and to float the carbonates at a pH that differs from the one used during the first stage.

When the technique described in the patents specified above is applied to the magnesium phosphates of Florida, it does not make it possible to achieve marketable concentrations, even when the technique is modified thoroughly. As a matter of fact, it is not possible to obtain phosphates the grade of which amount to more than 60% of BPL and to less than 1% of magnesium (Mg O/BPL less than 60), with a yield exceeding 80% of the material subjected to the flotation process (see also Example 6).

None of the techniques described above produces satisfactory results when they are applied to phosphate ores from Florida; the average composition of which lies within the following ranges:

| | |
|---|---|
| Non-soluble (essentially silica) | 45% to 65% |
| $Ca_3(PO_4)_2$ | 10 to 20% |
| MgO | 3 to 6% |
| $Al_2O_3$ | 2 to 5% |
| $Fe_2O_3$ | 0.5 to 2% |

The classification in different groups which makes the liberation of particles of carbonate and phosphate possible is insufficient when the phosphate particles are covered with a thin coating of carbonate or a clay which forms the cement that holds the phosphate grains together. If the surface phosphate layer is contaminated with carbonate traces, the flotation selectivity is changed due to the fact that phosphates behave exactly like carbonates, thus requiring the presence of phosphate-eliminating agents which increases the cost of the process. In addition, the separation of phosphate and silica cannot be carried out in a single flotation step. An additional cationic flotation step is required in accordance with a technique presently used in the treatment of phosphate ores from Florida.

From the above, it is apparent that there exists a need for a process for treating phosphate ores containing a magnesia-rich carbonate-containing gangue(dolomite) and a silica-containing gangue.

Accordingly, it is an object of the present invention to provide a process for the beneficiation of phosphate ores having a gangue containing dolomite and/or calcite as well as silica.

It is a further object of the present invention to provide a process for the beneficiation of phosphate ores whereby the carbonates contained in the gangue are advantageously liberated and removed.

It is yet another object of the present invention to provide a phosphate ore beneficiation process whereby the magnesia content of the phosphate product is reduced advantageously.

It is another object of the present invention to provide a beneficiation process for phosphate ores, which process is inexpensive and does not require the use of expensive reagents.

SUMMARY OF THE INVENTION

The present invention provides a process for the beneficiation of phosphate ores having a magnesia-rich clay- and carbonate-containing gangue and a silica-containing gangue; applying a stage of controlled attrition to the phosphate-containing ore so as to eliminate part of the magnesium-rich clay- and carbonate-containing gangue; separating the resulting particles into a fine fraction and a coarse fraction; and subjecting the coarse fraction to a plurality of flotation processes to remove the remaining silica and carbonates and to recover a concentrated phosphate product. Alternatively, the attrition step can be employed after the silica flotation and prior to the carbonate flotation.

It has been found that by subjecting the particles to controlled attrition, the superficial layers of the phosphate particles are eliminated without the destruction of the phosphate particles so that subsequent selective flotation separation processes can be effectively employed. In addition, controlled attrition makes possible a considerable reduction in the consumption of reagents required to float the phosphate-containing particles. The combination of stages of attrition and flotation in accordance with the present invention provides a synergistic effect as to consumption of reagents. It has to be stressed that this synergistic effect can be observed in connection with all operations of floating phosphate, even in non-dolomitic materials (see also Example 5).

DETAILED DESCRIPTION OF THE INVENTION

Figure 1:
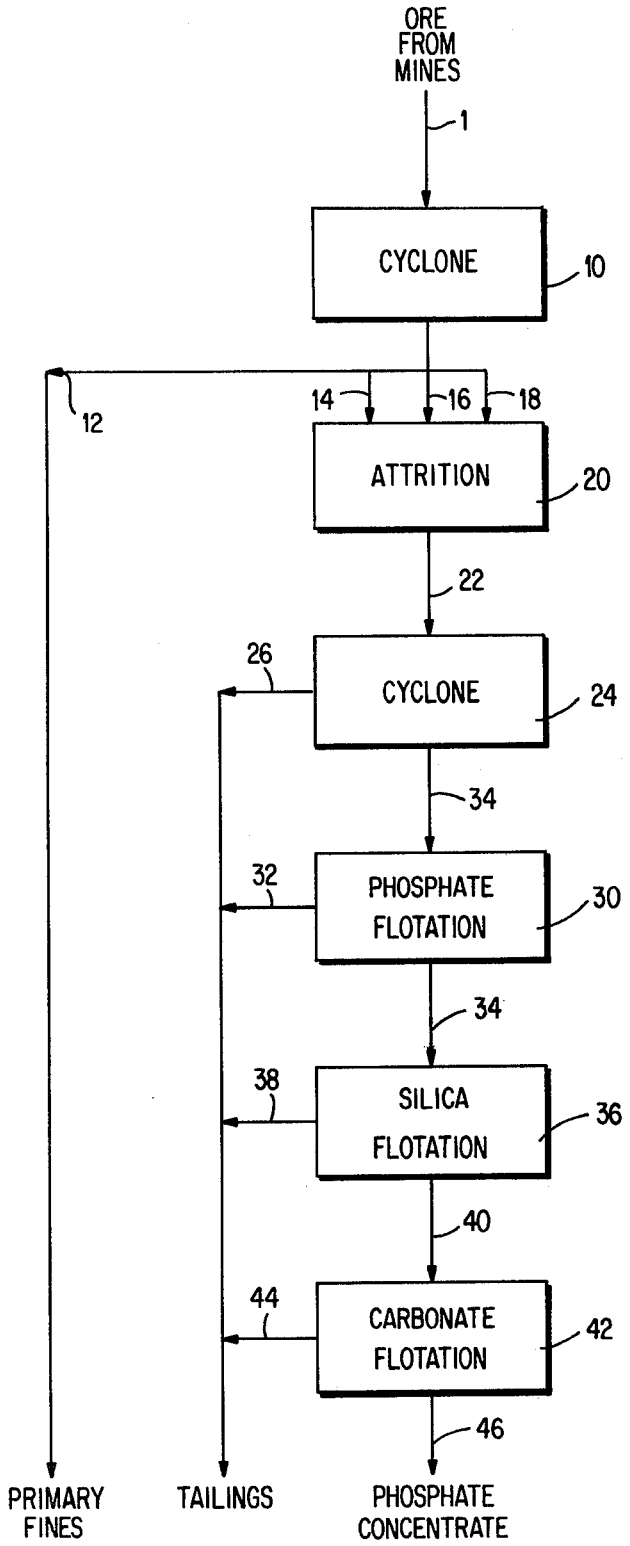
FIG. 1 illustrates the present invention as described in Examples 1, 2 and 3.

The present invention is directed to phosphate ores having a magnesia-rich carbonate-bearing gangue and a silica containing gangue, such as certain phosphate ores which are found in Florida. According to the present invention, the phosphate ore is at first washed and then classified, such as by means by cycloning into four fractions, the first fraction having a particle diameter less than 100 microns (i.e., the particles will pass through a 150 mesh screen in the Tyler sieve series), the second fraction having a particle diameter ranging from 100 microns to 500 microns (i.e., the particles will pass through a 32 mesh screen but will be retained on a 150 mesh screen in the Tyler sieve series), the third fraction having a particle diameter ranging from about 500 microns to 6.7 mm—¼ inch—(i.e., the particles will pass through a 3 mesh screen but will be retained on a 32 mesh screen in the Tyler sieve series), and the fourth fraction having a particle diameter greater than 6.7 mm (i.e., the particles will be retained on a ¼ inch mesh screen in the Tyler sieve series). It is important to note that the cut between the second and the third fraction (500 microns—32 mesh) is dependent on the performances of the floating machines and that such a cut-off may lie between 400 and 650 microns as is actually the case in Florida. The first fraction having a particle diameter of less than 100 microns is discarded as primary fines since they contain primarily silica, alumina, iron and magnesium. The second fraction is subjected to controlled attrition so as to eliminate the surface gangue of clay and dolomite and to clean the surface of the particles so as to facilitate the subsequent selective separation of phosphate from the gangue by flotation. The fourth fraction is discarded since it has a very high amount of dolomite and a low apatite content. The third fraction is preferably ground prior to the attrition stage so that $d_{80}$ as defined below may range from 250 to 500 microns.

At this point, it is important to note the difference between controlled attrition (hereinafter "attrition") and grinding. Attrition is not grinding, scufffing or pulverization. It is not a rough fragmentation nor it is a breaking or crumbling. In essence, attrition accomplishes a movement of the particles and frees the friable parts from the ore particles. It is a matter of bringing about a moderate mechanical action or shaking which frees the friable parts from the ore particles without breaking them.

When plotted on a Rosin-Rammler diagramm, the successives slopes of a series of straight lines corresponding to the size ranges obtained by successive attrition processes are decreasing. By contrast, those corresponding to the size ranges obtained by successive crushings remain parallel or have a slight tendency to become vertical. The Rosin-Rammler diagram does not teach the precise conditions for attrition, but does provide an excellent means by which those skilled in the art can determine whether the proper conditions for attrition have, in fact, been chosen.

Although the examination of a Rosin-Rammler diagram represents the most exact criterion and is best suited for differentiating attrition from crushing or pulverization, other secondary criteria also may be used. Attrition may be defined on the basis that $d_{95}$ does not decrease by more than 20%, preferably by not more than 10%, in the course of attrition, and that for periods which, at an industrial scale, may be very long. $d_{95}$ is defined as the smallest mesh size through which 95% of the particles are able to pass.

Attrition also may be defined by the fact that $d_{90}$ and $d_{80}$, after successive attritions, do not decrease by more than 40 to 70%, respectively, and preferably does not decrease by more than 20 to 30%, respectively. Another criterion defines attrition by the fact that the ratio $d_{80}/d_{20}$ is multiplied by a factor of at least 1.1, preferably by a factor greater than or equal to 1.2, as a result of the attrition. On the other hand, it should be noted that the ratio $d_{80}/d_{20}$ decreases slightly or remains constant as a result of grinding. There also is a relationship between the ratio $d_{90}/d_{10}$ or the ratio $d_{80}/d_{20}$ and the slope of the straight line on the Rosin-Rammler diagram.

An additional secondary criterion, which is the simplest to use, defines attrition by the fact that the ratio $d_{80}/d_{20}$ increases in the course of successive attritions by at least a factor 1.05, preferably by a factor greater than 1.1. Since the ratio $d_{80}/d_{20}$ is easily and readily calculated, this secondary criterion represents the simplest way of defining attrition. $d_{90}$, $d_{80}$, $d_{20}$ and $d_{10}$ are defined as the smallest mesh size through which 90%, 80%, 20% and 10%, respectively, of the particles (in weight) are able to pass.

Attrition can be performed with several machines and one of the best ways to carry out attrition is by stirring a pulp comprising the ore particles and a liquid, such as water, in a tank. The solids content of the pump is from about 60 to 80% by weight, preferably from about 70 to 80% by weight. To prevent any fragmentation of the phosphate grains and major $P_2O_5$ losses in the slimes (less than 100 microns), it is necessary to carry out the attrition step so that at the time of the collision between two particles, the relative speed of the particles is less than 5 meters per second, preferably from about 1.8 to about 4 meters per second.

A stirring tank equipped with a system of blades and particularly fitted for carrying out the attrition step of the present invention is described in French Pat. No. 78/32217. According to this patent, the apparatus comprises a stirring tank fitted with impellers, all of which have the same diameter and are mounted on a common shaft. The blades of the impellers are arranged so that as the impellers rotate, the particles are forced into the space between the impellers, thus causing the particles to collide with one another to effect attrition. When using the above-described apparatus, the operating conditions should be adjusted so that the pulp passes from about 1,000 to 10,000 times per hour through the tank, and preferably from about 2,000 to 5,000 times per hour. The linear speed of the pulp, while crossing the impeller ranges from about 0.9 to 2.4 meters per second, preferably from about 1.5 to 2.0 meters per second. The residence time of the pulp in the stirring tank range from about 5 to 60 minutes, with from about 5 to 10 minutes preferred.

After the attrition step, the second and third fractions are each treated to separate the fine magnesia-rich particles from the coarser particles resulting from the attrition step. For example, and referring to the second fraction, the fine particles have a diameter less than about 63 microns, or generally than 100 microns, in round figures, and are rich in magnesia. The fine particles are separated from the coarser particles by hydrocycloning. The fine particles having a diameter of less than about 100 microns in round figures (63 microns in the tests of this Application) are discarded as tailings. The coarser particles having a diameter greater than about 63 microns typically contain about 0.2 to 0.4% by weight of magnesia.

The classification sizing to obtain the secondary slimes created by attrition may be choosen in a range between 325 mesh and 150 mesh since particles produced by attrition present usually a size smaller than 325 mesh.

The preconcentrates, i.e., the coarser particles from each of the second and third fractions, are then separately subjected to a plurality of flotation steps to recover a concentrated phosphate product. According to the present invention, three flotation steps are used. In the first step, phosphate particles and gangue are separated. The residual silica in the phosphate concentrate obtained in that way is separated by means of a second flotation step. Then, the phosphate concentrate is subjected to a third flotation step to remove the carbonates. It has been found that by applying the combination of an attrition step and a three-step flotation process to phosphate ores found in Florida, the magnesia content in the phosphate product is substantially decreased This combined attrition and flotation process provides a substantial improvement over the known two-stage flotation process which involved only the flotation of phosphate and silica. Such a two-stage flotation process yields a phosphate product having a magnesia content of about 1.56% by weight. By contrast, by using the present invention, the magnesia content in the phosphate product is less than 1% by weight:

| | Concentrate Assays | | |
|---|---|---|---|
| PRODUCT | Recovery % | % BLP | % MgO |
| 250–32 mesh treated with conventional flotation | 92.8 | 62.7 | 1.56 |
| 250–32 mesh treated following the process of the invention | 85 | 66.6 | 0.73 |

According to the present invention, in the first flotation step, the coarser particles obtained as a result of attrition and cycloning are mixed with water to form a pulp having a solids concentration of from about 60 to 75% by weight, preferably about 70%. The pulp is kept suspended by agitating with a suitable stirrer, such as a turbine-type impeller. The pH of the pulp is within the range of about 8.0 to 9.0, preferably about 8.5. The pH value may be maintained by adding an alkaline solution, such as sodium hydroxide, to the pulp prior to the introduction of a collector. The collector comprises an aqueous solution including the following ingredients:

| Ingredients | Broad (Weight %) | Preferred (Weight %) |
|---|---|---|
| Tall Oil | 3–7 | 5 |
| Domestic Fuel | 4–8 | 6 |
| Soda | 0.5–1.5 | 0.5 to 1.0 |

Instead of soda, alkali hydroxides or ammonia may be used. The collector is added to the pulp in an amount of about 600 to 1200 grams per metric ton of the product. The conditioning of the pulp is complete within a relatively short period of time, typically from 2 to 5 minutes.

After the ore has been properly conditioned, flotation of the pulp is carried out at a solids concentration of from about 18 to 22% by weight, preferably about 20%, and at a pH of from about 7.5 to 9.5, preferably from about 8.5 to 9.5. Flotation is generally conducted for a period of about 30 to 60 seconds. The amount of reagents consumed per ton of ore for the second fraction treated are: tall oil from about 500 to 600 grams; domestic fuel from about 700 to 800 grams; and soda from about 70 to about 80 grams. The overflow product comprises the flotation concentrate and the underflow comprises the tailings.

Even though other anionic collectors of the carboxylic-acid type with long chains may be suitable, the residue from wood-pulping known by the name of "tall oil" or "tallol" which is of Scandinavian origin, is the most suitable means because of its qualities as a collector and of its low price.

The flotation concentrate obtained in the first flotation step is then subjected to an acid wash. The concentrate is washed, at a solids concentration of from about 60 to 70% by weight in an acid medium having a pH of from about 3 to 4 for a short period of time, typically about 1 minute. A useful acid for the acid wash is sulfuric acid. The amount of sulfuric acid used is from about 1,000 to 1,500 g/t of ore. After the acid wash, the ore is washed with water, after which the ore is ready for the second flotation step.

In the second flotation step, the residual silica in the phosphate concentrate is removed. According to this flotation step, the residual silica in the phosphate concentrate is floated at a pH of from about 6 to 8, preferably about 7, with a suitable flotation reagent. The solids concentration in this flotation step is from about 18 to 25% by weight, preferably about 20% by weight. The flotation is conducted for a period of about 1 to 5 minutes, preferably about 2 minutes. As an example of a suitable flotation reagent, an emulsion of kerosene and an amine such as Aeromine 3037, which is a cationic collector manufactured by American Cyanamid, can be used. Typically, the amount of flotation reagents consumed per ton of flotation feed is: amine—50 to 180 grams and kerosene—50 to 180 grams. The underflow product comprises the phosphate concentrate and the overflow the silica gangue.

After the second flotation step, the remaining impurities which are to be removed by flotation are the carbonates. The phosphate concentrate obtained in the second flotation step is washed with water to completely remove the amine contained herein. The phosphate concentrate is conditioned at a solid concentration of from about 20 to 50% by weight, preferably from about 20 to 30% by weight, with phosphoric acid at a pH of from about 4 to 6, preferably from about 5 to about 5.8, for a period of from about 1 to 10 minutes, preferably from about 1 to 4 minutes. The amount of phosphoric acid consumed ranges from about 300 to 1200 g/t of flotation feed.

The concentrate is further conditioned by adding a collector, which may be in the form of an aqueous emulsion or not, including the following ingredients:

| Ingredients | Broad (Weight %) | Preferred (Weight %) |
|---|---|---|
| Tall oil | 3–7 | 5 |
| Domestic fuel | 4–8 | 4 to 6 |
| Soda | 0.5–1.5 | 0.5 to 10 |

The concentrate is conditioned for a period of from about 1 to 10 minutes, preferably about 4 minutes. The amount of conditioning ingredients consumed per ton of flotation feed are as follows: tall oil from about 300 to 1000 grams, domestic fuel from about 360 to 1200 grams, and soda from about 40 to 120 grams.

After conditioning, the concentrate is subjected to flotation. For this third flotation step, frothers such as an alkylsulphate or an alcohol (e.g., polyglycol) may be added. The flotation of the carbonates is carried out for a period of from about 1 to 10 minutes, preferably about 2 to 5 minutes, at a solids concentration of from about 15 to 25% by weight, preferably about 20% by weight, and at a pH of from about 4 to 6, preferably about 5.5. The pH of the pulp may be controlled by the addition of phosphoric acid. It is important to maintain the pH within the range 4 to 6, preferably 5 to 5.8, during the conditioning and flotation in order to avoid the flotation of phosphates. The overflow product from the third flotation step contains primarily the carbonate gangue material (principally dolomite) and the underflow product comprises the phosphate concentrate.

Using the above-described combination of attrition the flotation steps, the phosphate concentrate obtained from the second and third fractions typically has the following composition:

| Material | Weight % |
|---|---|
| BPL | 64–66 |
| MgO | 0.7–0.8 |
| $SiO_2$ | 2–5 |
| $Fe_2O_3 + Al_2O_3$ | 2.5 |

The BPL (bone phosphate lime) recovery is from about 85 to 92%, with respect to the feed after silica flotation.

In the third flotation step, the collector is the same as that used in the flotation of phosphates. The combination of this collector, which is an inexpensive residue of the paper-pulp industry, with a depressing agent such as phosphoric acid, is a particularly attractive solution for the flotation of carbonates on an economical basis. In the prior art, synthetic fatty acids having a high degree of purity have usually been used, thus increasing the cost of the operation.

In the above description of the present invention, it has been stated that the attrition step is first conducted, followed by the flotation steps. However, the present invention also may be realized by first removing phosphate and silica by flotation from each of the second, third and fourth fractions. Thereafter, the phosphate concentrates are subjected to attrition and then the carbonates removed from the phosphate concentrates by flotation. The results obtained by using this procedure are substantially the same as those obtained in the previously described procedure, with the exception of reagent consumption in the phosphate flotation.

EXAMPLES

The present invention is further illustrated in the following examples. It is emphasized that the examples are for illustrative purposes only and in no way limit the present invention.

With reference to FIG. 1, phosphate ore from Florida, 1, which included quartz, francolite, microcline, and calcite bound together by dolomite in the upper layers and by clay and fine dolomite in the smaller fractions, was classified into four fractions, 12, 14, 16, and 18, by means of cyclone 10. Fraction 12 having a particle diameter of less than 63 microns comprises the primary fines and is not treated. Fractions 14, 16, and 18, having particle diameters of 63 to 500 microns, 500 to 1000 microns, and over 1000 microns, respectively, are treated in accordance with the present invention. The general composition of the fractions is set forth in the Table below wherein the composition of fraction 14 is broken down into two size ranges, namely, 63 to 125 microns and 125 to 500 microns:

| Size Fraction | | | | | | | |
|---|---|---|---|---|---|---|---|
| | Mesh (Tyler | Weight | Grade % | | | Recovery % | |
| Microns | series) | % | $P_2O_5$ | BPL | MgO | BPL | MgO |
| 1000 | 16 | 4.8 | 15.20 | 33.21 | 7.0 | 11.0 | 7.4 |
| 500–1000 | 32–16 | 6.8 | 16.10 | 35.17 | 2.79 | 16.5 | 4.1 |
| 125–500 | 115–32 | 54.9 | 7.00 | 15.29 | 0.58 | 57.9 | 6.9 |
| 63–125 | 250–115 | 4.8 | 6.30 | 13.76 | 1.65 | 4.5 | 1.7 |
| 63 | 250 | 28.7 | 2.35 | 5.13 | 12.90 | 10.1 | 79.9 |
| | TOTAL | 100.0 | 6.64 | 14.50 | 4.63 | 100.0 | 100.0 |

EXAMPLE 1

The particles from fraction 14 having particle diameters of 63 to 500 microns were subjected to attrition 20. The particles were mixed with water to form a pulp, the solids content of the pulp being about 70% by weight. The pulp was stirred in a tank having two impellers mounted apart from each other on a common shaft. The blades of the impellers were arranged so that as the impellers rotate, the pulp was drawn into the space between the two impellers causing the particles in the pulp to collide with one another, thus effecting attrition. The stirring was continued until the fraction $d_{80}/d_{20}$ is multiplied by a factor equal to approximately 1.15, $d_{80}$ and $d_{20}$ being the smallest mesh size through which 80% and 20%, respectively, of the particles were able to pass. After the attrition step, the particles were fed to cyclone 24 via 22 and were separated into two fractions, 26 and 28. Fraction 26 had a particle diameter of less than about 63 microns, whereas the particle diameter of fraction 28 greater than 63 microns. The fine fraction which contains magnesia-rich particles was removed as tailings via 26. The coarser fraction was fed to the first flotation step via 28.

The fraction 28 was conditioned at a solids concentration of about 70% by weight. The particles were suspended by means of a turbine-type impeller. The pH of the pulp was adjusted to within the range of 8.5 to 9.5 by adding ammonium hydroxide. A collector having the following composition was added to the pulp:

Tall oil 5% by weight
Domestic fuel 6% by weight
Soda 0.5 to 1.0% by weight

The concentrate was conditioned with this collector for two minutes at a pH of 9 to 10. Thereafter, phosphate flotation 30 is carried out at a solids concentration of 18 to 22% by weight and at a pH of between 8.5 and 9.5 for a period of 30 to 60 seconds. The flotation concentrate so-obtained was washed at a solids concentration of about 60 to 70% by weight with sulfuric acid at a pH of from 3 to 4 for one minute. After the acid wash, the particles were washed with water and fed to silica flotation 36 via 34. The tailings which comprise the gangue were eliminated via 32.

In silica flotation 36, the phosphate concentrate from phosphate flotation 30 is floated at a pH of 7 with an aqueous emulsion containing 1% by weight Aeroamine 3037 and 1% by weight kerosene for about 2 minutes at a solids concentration of 18 to 22% by weight. The phosphate concentrate was fed to carbonate flotation 42 via line 40 and the silica tailings were eliminated at 38.

The phosphate concentrate from silica flotation 36 was washed with water to remove the Aeroamine 3037 collector contained therein. Thereafter, the particles were treated at 20 to 30% by weight solids for 1 to 4 minutes with phosphoric acid at a pH of 4.5 to 5.5. The particles were further conditioned with an aqueous emulsion of 5% tall oil, 4 to 6% domestic fuel, and 0.5 to 1% soda for four minutes. Then flotation stage 42 was carried out at a pH ranging from 4 to 6 during 2 to 5 minutes, at a solids concentration of 18 to 22% by weight, the pH being maintained by the addition of phosphoric acid. The tailings were eliminated at 44 and the phosphate concentrate was collected via line 46. The results obtained are summarized in Table 1.

TABLE 1

| | | Weight | Grade % | | | Recovery % | |
|---|---|---|---|---|---|---|---|
| OPERATION | PRODUCT | % | $P_2O_5$ | BPL* | MgO | BPL | MgO |
| | Matrix | 100.0 | 6.64 | 14.50 | 4.63 | 100.0 | 100.0 |
| SIZING | Flotation Feed 250–32 mesh | 59.7 | 6.94 | 15.16 | 0.66 | 62.4 | 8.6 |
| ATTRITION SCRUBBING | Concentrate | 57.6 | 6.81 | 14.87 | 0.32 | 59.1 | 4.0 |
| | Tailing | 2.1 | 10.4 | 22.72 | 10.1 | 3.3 | 4.6 |
| | Total | 59.7 | 6.94 | 15.16 | 0.66 | 62.4 | 8.6 |
| PHOSPHATE & SILICA | Concentrate | 12.2 | 29.6 | 64.66 | 1.14 | 54.43 | 3.0 |
| | Tailing | 45.4 | 0.68 | 1.49 | 0.10 | 4.67 | 1.0 |
| FLOTATION | Total | 57.6 | 6.81 | 14.87 | 0.32 | 59.1 | 4.0 |
| CARBONATE FLOTATION | Phosphate Concentrate | 11.6 | 30.4 | 66.6 | 0.73 | 53.3 | 1.7 |
| | Carbonate Tailing | 0.6 | 12.45 | 27.30 | 9.15 | 1.13 | 1.2 |

TABLE 1-continued

| OPERATION | PRODUCT | Weight % | Grade % $P_2O_5$ | Grade % BPL* | Grade % MgO | Recovery % BPL | Recovery % MgO |
|---|---|---|---|---|---|---|---|
| | Total | 12.2 | 28.0 | 64.66 | 1.14 | 54.4 | 3.0 |

*BPL = bone phosphate lime

EXAMPLE 2

The procedure outlined in Example 1 was repeated, with the exception that particles from fraction 16 having a diameter ranging from 500–1000 microns were used. The results obtained are summarized in Table 2. Although fraction 16 contained more MgO than fraction 14, the results are similar to those obtained in Example 1 with respect to the MgO content.

TABLE 2

| OPERATION | PRODUCT | Weight % | Grade % $P_2O_5$ | Grade % BPL | Grade % MgO | Recovery % BPL | Recovery % MgO |
|---|---|---|---|---|---|---|---|
| | Matrix | 100.0 | 6.64 | 14.50 | 4.63 | 100.0 | 100.0 |
| SIZING | Flotation feed 32–16 mesh | 6.8 | 16.23 | 35.47 | 2.67 | 16.6 | 3.9 |
| ATTRITION SCRUBBING | Concentrate | 5.9 | 17.02 | 37.2 | 1.57 | 15.1 | 2.0 |
| | Tailing | 0.9 | 11.07 | 24.2 | 9.90 | 1.5 | 1.9 |
| | Total | 6.8 | 16.23 | 35.47 | 2.67 | 16.6 | 3.9 |
| PHOSPHATE & SILICA FLOTATION | Concentrate | 1.8 | 27.29 | 59.62 | 1.02 | 7.4 | 0.4 |
| | Tailing | 4.1 | 12.49 | 27.3 | 1.76 | 7.7 | 1.6 |
| | Total | 5.9 | 17.02 | 37.2 | 1.57 | 15.1 | 2.0 |
| CARBONATE FLOTATION | Phosphate Concentrate | 1.6 | 30.29 | 66.2 | 0.77 | 7.3 | 0.3 |
| | Carbonate Tailing | 0.2 | 3.32 | 7.25 | 2.31 | 0.1 | 0.1 |
| | Total | 1.8 | 27.29 | 59.62 | 1.02 | 7.4 | 0.4 |

EXAMPLE 3

The procedure outlined in Example 1 was repeated, with the exception that particles from fraction 18 having a particle diameter greater than 1000 microns were used and these particles were subjected to a preliminary grinding at $d_{80}=500$ microns prior to attrition. The results obtained are summarized in Table 3.

TABLE 3

| OPERATION | PRODUCT | Weight % | Grade % $P_2O_5$ | Grade % BPL | Grade % MgO | Recovery %* BPL | Recovery %* MgO |
|---|---|---|---|---|---|---|---|
| | Size fraction >16 mesh | 100.0 | 18.24 | 39.95 | 6.42 | 100.0 | 100.0 |
| GRINDING | Concentrate | 79.2 | 19.98 | 43.65 | 5.00 | 86.74 | 61.68 |
| | Tailing | 20.8 | 11.63 | 25.43 | 11.83 | 13.26 | 38.32 |
| | Total | 100.0 | 18.24 | 39.95 | 6.42 | 100.0 | 100.0 |
| ATTRITION SCRUBBING | Concentrate | 66.8 | 20.99 | 45.86 | 3.98 | 76.89 | 41.66 |
| | Tailing | 12.4 | 14.6 | 31.90 | 10.50 | 9.92 | 20.28 |
| | Analysed Attrition Feed | 79.2 | 19.98 | 43.63 | 5.00 | 86.74 | 61.68 |
| PHOSPHATE & SILICA FLOTATION | Concentrate | 48.7 | 24.25 | 52.98 | 3.50 | 64.74 | 26.61 |
| | Tailing | 18.1 | 12.25 | 26.76 | 5.27 | 12.15 | 14.85 |
| | Total | 66.8 | 20.99 | 45.86 | 3.98 | 76.89 | 41.46 |
| CARBONATE FLOTATION | Phosphate Concentrate | 37.94 | 29.7 | 64.89 | 0.86 | 61.62 | 5.08 |
| | Carbonate Tailing | 10.76 | 5.03 | 10.99 | 12.89 | 3.12 | 21.53 |
| | Total | 48.7 | 24.25 | 52.98 | 3.50 | 64.74 | 26.6 |

*The recovery rate was computed with respect to the fraction >16 mesh.

EXAMPLE 4

In this example, the method used was identical to that described in Example 1. However, the sequence of the steps was changed.

Figure 2:
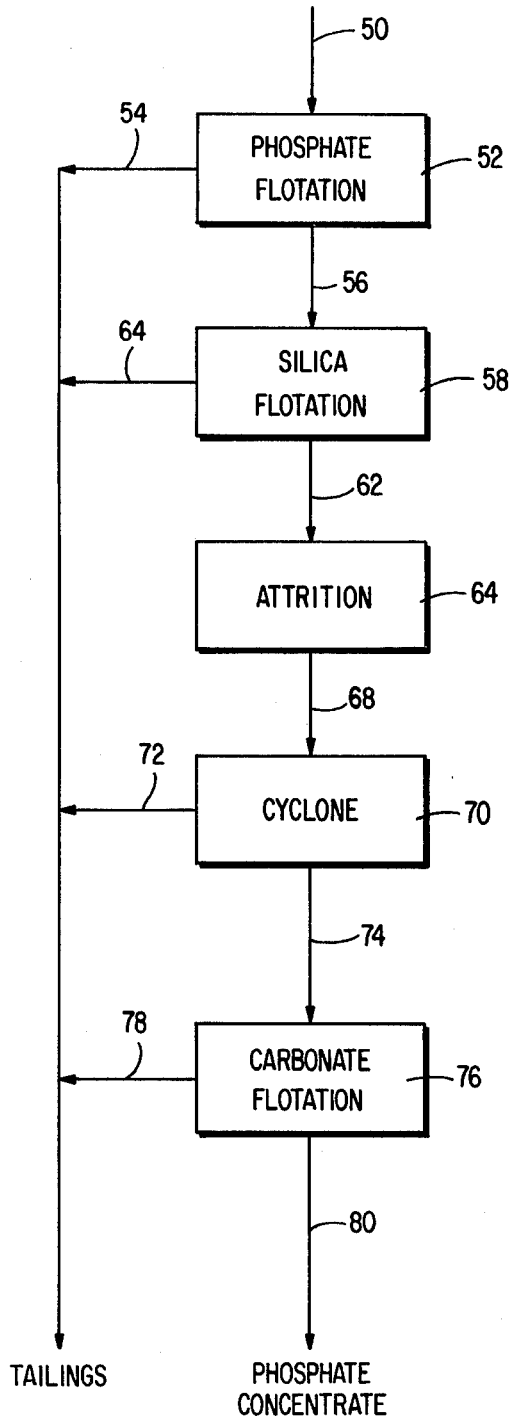
FIG. 2 illustrates the present invention as described in Example 4.

Reference is made to FIG. 2; particles having a diameter of 63–500 microns were fed via 50 to phosphate flotation stage 52. The tailings were removed at 54, and the phosphate concentrate was fed to silica flotation stage 58 via 56. After silica flotation, the phosphate concentrate exited via 62 and the tailings were removed via 60. The phosphate concentrate was then subjected to the attrition stage 64. The products of attrition were fed to cyclone 70 via 68. The fine particles of gangue material were removed from cyclone 70 via 72 and the phosphate concentrate was eliminated via 74. The phosphate concentrate was then fed to carbonate flotation stage 76 and the carbonates were removed via 78. The final phosphate concentrate was collected via 80. The results obtained in this example are summarized in Table 4.

TABLE 4

| OPERATION | PRODUCT | Weight % | Grade % $P_2O_5$ | Grade % BPL | Grade % MgO | Recovery % BPL | Recovery % MgO |
|---|---|---|---|---|---|---|---|
| | Matrix | 100.0 | 6.64 | 14.50 | 4.63 | 100.0 | 100.0 |
| SIZING | Flotation feed 250–32 mesh | 56.5 | 6.90 | 15.07 | 0.48 | 58.7 | 5.8 |
| PHOSPHATE | Concentrate | 10.8 | 29.38 | 64.19 | 0.94 | 47.8 | 2.2 |
| & SILICA | Tailing | 45.7 | 1.58 | 3.45 | 0.36 | 10.9 | 3.6 |
| FLOTATION | Total | 56.5 | 6.90 | 15.07 | 0.48 | 58.7 | 5.8 |
| ATTRITION | Concentrate | 10.3 | 29.5 | 64.45 | 0.85 | 45.8 | 1.9 |
| SCRUBBING | Tailing | 0.5 | 25.9 | 56.59 | 3.21 | 2.0 | 0.3 |
| | Total | 10.8 | 29.38 | 64.19 | 0.94 | 47.8 | 2.2 |
| CARBONATE | Phosphate Concentrate | 10.0 | 30.2 | 65.98 | 0.75 | 45.5 | 1.6 |
| FLOTATION | Carbonate Tailing | 0.3 | 7.10 | 15.51 | 5.14 | 0.3 | 0.3 |
| | Total | 10.3 | 29.5 | 64.45 | 0.85 | 45.8 | 1.9 |

Example 5

Two tests were carried out in parallel. In the first test, the matrix is first freed from mud and slime, then is cycloned so as to eliminate fines, and the residual part (100 to 500 microns) is subjected to three flotations in accordance with the present invention. In the second test, the matrix is freed from mud and slime, then is cycloned to 100 microns so as to yield primary fines, and the residual part (100 to 500 microns) is subjected to an attrition step and then to three flotations in accordance with the present invention.

| Final Concentrate | Balance of the masses: % by weight | Chemical Analysis BPL | Chemical Analysis MgO | Recovery BPL | Recovery MgO |
|---|---|---|---|---|---|
| Test 1 | 18.0 | 63.6 | 0.7 | 74.3 | 26.7 |
| Test 2 | 19.5 | 64.6 | 0.7 | 81.9 | 28.4 |

These tests evidenced that an attrition followed by cycloning yielding secondary fines with a process of attrition lasting, at least five minutes, produces after the repeated flotations a concentrate with BPL and levels of impurities similar to those of a concentrate that has not been subjected to that attrition. However, in any case, the yield of BPL following the process of attrition and secondary cycloning makes possible to raise the recovery from 74 to 82%, while the consumption of the reagent amounts to less (1470 grams/ton compared to 660 gram/ton of tall oil). The difference in consumption is particularly evident at the first phosphate flotation which is a flotation that is generally used in Florida.

Example 6

Tests were performed, in accordance with the technique of U.S. Pat. Nos. 3,462,016 and 3,462,017, with a Florida ore from Hardee County. The operating conditions were as described in Example 1 of those two patents.

Using those operating conditions, it was not possible to obtain any enrichment, inasmuch as the entire ore was floated and no separation was observed. For this reason, it was necessary to modify the manner of operation in order to be able to obtain any measurements.

A fraction of 63 to 500 microns (which is different from the operating conditions of U.S. Pat. No. 3,462,016), i.e., a fraction that has undergone a process of removing slimes, was ground to a $d_{70}$ of 74 microns and then subjected to the techniques described in Example 1 of U.S. Pat. No. 3,462,016. The results obtained are found in Table 5 below.

It seems appropriate to point out that, for the carbonate flotation, a very large amount of phosphoric acid was necessary in order to bring the pulp to pH 5. Moreover, the carbonate flotation led to a froth that did not contain any ore particles.

The conditions that are not precisely stated in Example 1 of U.S. Pat. No. 3,462,016 were as follows:

| Phosphate flotation | |
|---|---|
| Period of conditioning | 180 seconds |
| Solid contents | 65% |
| pH between 9 and 10.5 with the following reagents: | |
| Tall oil | 750 g/t |
| Soda | 500 g/t |
| Sodium silicate | 485 g/t |
| Sodium silicate was added to depress the silica. | |

Flotation was performed over a period of 120 seconds, with solid contents amounting to 35% at a pH of 9.5.

| Carbonate flotation | |
|---|---|
| Period of conditioning | 180 seconds |
| pH 5 with the following reagents | |
| Tall oil | 88 g/t |
| Soda | 120 g/t |

Flotation was performed for a period of 120 seconds without producing any froth containing ore.

TABLE 5

| | Masses g | Masses % | Contents % $P_2O_5$ | Contents % BPL | Contents % MgO | Distribution % $P_2O_5$ | Distribution % MgO |
|---|---|---|---|---|---|---|---|
| Supply | 1121.3 | 100 | 6.70 | 14.6 | 0.88 | 100 | 100 |
| Reject $P_2O_5$ | 946.9 | 84.4 | 5.75 | 12.6 | 0.63 | 71.9 | 60.9 |
| Rough $P_2O_5$ Concentrate | 174.4 | 15.6 | 12.2 | 26.7 | 2.20 | 28.1 | 39.1 |
| Carbonate Concentrate | 0 | 0 | | | | | |
| Final $P_2O_5$ Concentrate | 174.4 | 15.6 | 12.2 | 26.7 | 2.20 | 28.1 | 39.1 |

A second test was carried out under the same conditions, but without grinding, and eliminating the fines of less than 63 microns following phosphate flotation; these fines were formed during flotation.

The results are summarized in Table 6:

TABLE 6

| | Masses | | Contents % | | | Distribution % | |
|---|---|---|---|---|---|---|---|
| | g | % | $P_2O_5$ | BPL | MgO | $P_2O_5$ | MgO |
| Supply | 1122.1 | 100 | 6.70 | 14.6 | 0.88 | 100 | 100 |
| Rejected $P_2O_5$ | 1026 | 91.4 | 5.60 | 12.2 | 0.65 | 70.6 | 70.2 |
| Rough $P_2O_5$ Concentrate | 96.1 | 8.6 | 24.8 | 54.3 | 2.95 | 29.4 | 29.8 |
| Fines | 14.5 | 1.3 | 5.90 | 12.9 | 12.8 | 1.1 | 19.5 |
| Fines and Rejects | 1040.5 | 92.7 | 5.60 | 12.2 | 0.82 | 71.7 | 89.7 |
| $P_2O_5$ Precipitate | 81.6 | 7.3 | 28.2 | 61.6 | 1.20 | 28.3 | 10.3 |
| Carbonate Concentrate | 7.4 | 0.7 | 24.3 | 53.1 | 3.76 | 2.2 | 2.9 |
| $P_2O_5$ Concentrate | 74.2 | 6.6 | 28.6 | 62.5 | 0.94 | 26.1 | 7.4 |

Conclusion:

The tests show that, among the constraints to be observed so as to start the application of the method, the following should be noted:

A good slime removal should be performed following an attrition which has to be pushed to a point where no new fines will be created during the stages of flotation. It is preferable that the level of fines (=approximately 100 microns) amount to less than 3% and preferably 1%, and that in the case of ores specified above, the period of attrition last at least five minutes. That point is essential if one wants to reduce the consumption of reagents.

The anionic reagent must be thoroughly eliminated by the time of completion of the first flotation, if one wants the phosphate yield to reach acceptable economic levels.

The size of the product particles subjected to the flotation cycle must be sufficiently large ($d_{90}$ exceeding 100 microns).

The presence of fuel makes it possible to improve the yield of flotation in anionic flotations.

Figure 3:
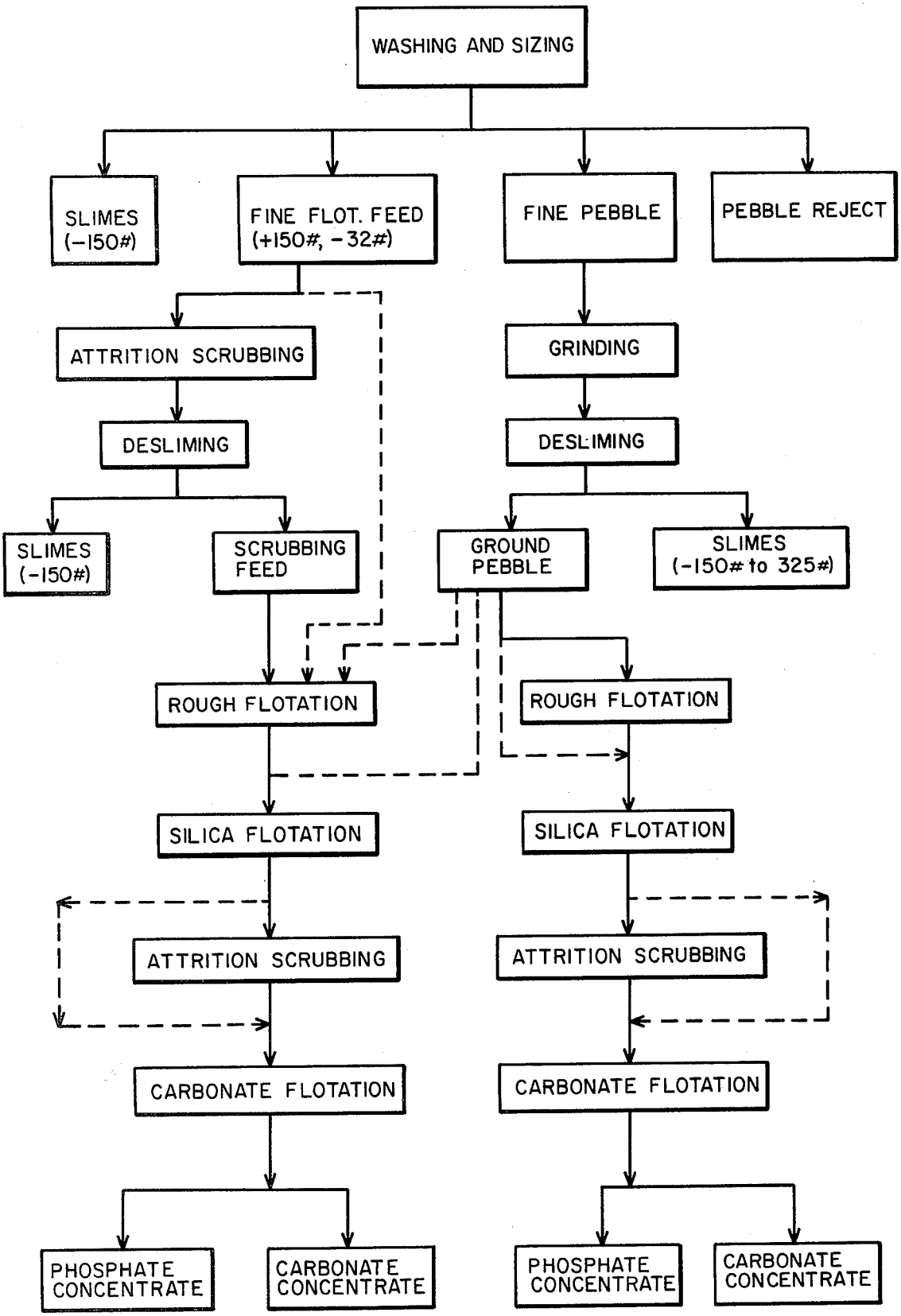
FIg. 3 is a flow sheet showing a preferred embodiment of the present invention.

FIG. 3 shows a preferred embodiment of the present invention.

The matrix is first washed and sized. The slimes, i.e. the particles smaller than about 150 mesh are discarded. The fine flotation feed, as well as the fine pebbles (between +32 mesh and a size selected within the range ¼ inch and 16 mesh), are submitted to the process according to the invention described hereafter. The pebbles presenting a size larger than the value selected within the range ¼ inch and 16 mesh are rejected. According to the continuous line embodiment, the fine flotation feed is first subjected to attrition scrubbing and is deslimed. The slimes newly produced (about 1 to 5%) are discarded. The scrubbed feed is submitted to a rough flotation, then to silica flotation and actually to a carbonate flotation giving a carbonate concentrate which is discarded and a phosphate concentrate which constitutes the upgraded phosphate.

According to the embodiment corresponding to the dotted line, the attrition scrubbing and the related desliming take place between silica flotation and carbonate flotation. The fine pebbles are first submitted to a grinding and a desliming. The slimes are discarded and ground pebbles are submitted to a rough flotation then to a silica flotation, the ore being submitted to an attrition scrubbing and to the carbonate flotation.

Obviously, depending on their analysis, the ground pebbles may either be subjected to an attrition before the rough flotation or be mixed with the fine flotation feed so that both fractions are subjected to the same attrition scrubbing, the same desliming and the same rough flotation.

If the composition allows it, the ground pebbles may also directly be mixed with the concentrate obtained by the rough flotation.

What is claimed is:

1. A process for the beneficiation of phosphate ore containing a magnesia-rich carbonate-containing gangue and a silica-containing gangue comprising:
   (a) washing and classifying the phosphate ore to form a first fraction comprising primary fines and removing the primary fines from the phosphate ore;
   (b) subjecting the phosphate ore to controlled attrition during a period of not less than 5 minutes to remove at least a portion of the magnesia-rich carbonate-containing gangue from the phosphate ore particles;
   (c) separating the particles resulting from (b) into a fine and a coarse fraction; and
   (d) subjecting the coarse fraction obtained in (c) to a plurality of froth flotations to remove the remaining magnesia-rich carbonate-containing gangue and the silica-containing gangue and to recover a concentrated phosphate product, said froth flotations including a phosphate flotation, a silica flotation and an anionic carbonate flotation.

2. The process of claim 1 wherein step (b) is conducted so that the ratio $d_{80}/d_{20}$ increases in the course of successive attrition by at least a factor of 1.05, $d_{80}$ and $d_{20}$ being the smallest mesh size through which 80% and 20%, respectively, of the particles will pass.

3. The process of claim 2 wherein step (b) is carried out by stirring in a tank a pulp containing from about 60% to 80% by weight of the ore with an agitator means so that the relative speed of any two ore particles in the pulp is less than 5 m/sec.

4. The process of claim 3 wherein the attrition is conducted for such a period that the mean residence time of the pulp in the tank is from 5 to 60 minutes.

5. The process of claim 3 wherein the rotational speed of the agitator means is so adjusted that the pulp passes from 1000 to 10,000 times per hour therethrough.

6. The process of claim 5 wherein the pulp passes from 2000 to 5000 times per hour through the agitator means.

7. The process of claim 3 wherein the rotational speed of the agitator means is so adjusted that the speed of the pulp while passing through the agitator means is from about 0.9 to 2.4 m/sec.

8. The process of claim 1, wherein step (d) comprises:
   (1) subjecting the coarse fraction to a first froth flotation step to separate phosphate particles from the gangue material;
   (2) subjecting the phosphate particles obtained in (1) to a second flotation step to remove residual silica; and
   (3) subjecting the phosphate particles obtained in (2) to a third anionic flotation step to remove the carbonate material.

9. The process of claim 8 wherein the first froth flotation step comprises conditioning the particles at a solids concentration of about 70% by weight, and a pH ranging from 9.0 to 10.0, for a period of 2 minutes and adding a collector comprising an aqueous emulsion of tall oil, domestic fuel, and soda; and separating the phosphates by froth flotation at a solids concentration ranging from 18 to 22% by weight, a pH of from 8.5 to 9.5, and for a period of from about 30 to 60 seconds.

10. The process of claim 8 wherein the second froth flotation step comprises flotation with an emulsion of an amine and kerosene at a pH of 7, a solids concentration ranging from about 18% to 20% by weight, and for a period of 2 minutes.

11. The process of claim 8 wherein the third froth flotation step comprises conditioning the particles with an aqueous emulsion of tall oil, domestic fuel, and soda for a period of 4 minutes, and separating the carbonates by flotation at a solids concentration ranging from about 8 to 22% by weight, a pH ranging from 4.5 to 6, and for a period of from 2 to 5 minutes.

12. The process of claim 11 wherein the pH is maintained by adding phosphoric acid.

13. A process for the beneficiation of phosphate ore containing a gangue containing carbonates and silica comprising:

(a) subjecting the phosphate ore to a first froth flotation step to separate the phosphate from the gangue;

(b) subjecting the phosphate concentrate obtained in (a) to a second froth flotation step to remove residual silica-containing gangue material;

(c) subjecting the phosphate concentrate obtained in (b) to controlled attrition to remove at least a portion of the magnesia-rich carbonate-containing gangue from the phosphate ore particles;

(d) separating the particles resulting from (c) into a fine and a course fraction; and (e) subjecting the coarse fraction obtained in (d) to a third anionic froth flotation step to remove the carbonate containing gangue and to recover a concentrated phosphate product.

14. The process of claim 13 wherein step (c) is conducted so that the ratio $d_{80}/d_{20}$ increases in the course of successive attrition by at least a factor of 1.05, $d_{80}$ and $d_{20}$ being the smallest mesh size through which 80% and 20%, respectively, of the particles will pass.

15. The process of claim 14 wherein the first froth flotation step comprises conditioning the particles at a solids concentration of 70% by weight, and a pH ranging from 9.0 to 10.0, for a period of 2 minutes and adding a collector comprising an aqueous emulsion of tall oil, domestic fuel and soda, and separating the phosphates by froth flotation at a solids concentration ranging from 18 to 22% by weight, a pH of from 8.5 to 9.5, and for a period ranging from 30 to 60 seconds.

16. The process of claim 14 wherein the second froth flotation step comprises flotation with an emulsion of an amine and kerosene at a pH of 7, a solids concentration ranging from 18 to 22% by weight, and for a period of 2 minutes.

17. The process of claim 14 wherein the attrition of step (c) is carried out by stirring in a tank a pulp containing 60 to 80% by weight of the ore, with an agitator means, so that the relative speed of any two ore particles in the pulp is less than 5 m/sec.

18. The process of claim 17 wherein the attrition is conducted over such a period that the mean residence time of the pulp in the tank is from 20 to 60 minutes.

19. The process of claim 17 wherein the rotational speed of the agitator means is calculated in such a way that the pulp passes 1,000 to 10,000 times per hour therethrough.

20. The process of claim 19 wherein the pulp passes 2,000 to 5,000 times per hour through the agitator means.

21. The process of claim 17 wherein the rotational speed of the agitator means is calculated in such a way that the speed of the pulp while passing through the agitator means is 0.9 to 2.4 m/sec.

22. The process of claim 13 wherein the third froth flotation step comprises conditioning the particles with an aqueous emulsion of tall oil, domestic fuel, and soda for a period of 4 minutes, and separating the carbonate by flotation at a solids concentration of 18 to 22% by weight, a pH of from about 4.5 to 6, and for a period of 2 to 5 minutes.

23. The process of claim 22 wherein the pH is maintained by adding phosphoric acid.

24. A process for the beneficiation of phosphate ore containing a magnesia-rich carbonate-containing gangue and a silica-containing gangue comprising:

(a) washing and classifying the phosphate ore to form a first fraction comprising primary fines and a fourth fraction a portion of which comprises coarse grains and removing the primary fines and the portion of the fourth fraction comprising coarse grains from the phosphate ore;

(b) subjecting the phosphate ore to controlled attrition during a period of not less than 5 minutes to remove at least a portion of the magnesia-rich carbonate-containing gangue from the phosphate ore particles;

(c) separating the particles resulting from (b) into a fine and a coarse fraction; and (d) subjecting the coarse fraction obtained in (c) to a plurality of froth flotations to remove the remaining magnesia-rich carbonate-containing gangue and the silica-containing gangue and to recover a concentrate phosphate product, said froth flotations including a phosphate flotation, a silica flotation and an anionic carbonate fraction.

25. The process of claim 24 wherein the phosphate ore subjected to controlled attrition comprises a second fraction and a third fraction having particle diameters within the range from about 100 to 1,000 microns.

26. The process of claim 24 wherein the primary fines have a particle diameter of less than about 100 microns.

27. The process of claim 24 wherein the portion of the fourth fraction remaining after the removal of the coarse grains is ground so that $d_{80}$ ranges from about 250 to 500 microns and is then subjected to controlled attrition.

28. The process of claim 24 wherein the portion of the fourth fraction comprising coarse grains is the portion retained on an about 3 mesh screen.

* * * * *